United States Patent [19]

Lampl

[11] Patent Number: 5,005,853

[45] Date of Patent: Apr. 9, 1991

[54] SKI

[75] Inventor: Heinz Lampl, Hohenems, Austria

[73] Assignee: Head Sportgeräte Gesellschaft m.b.H. & C.OHG., Kennelbach, Austria

[21] Appl. No.: 832,781

[22] Filed: Feb. 25, 1986

[30] Foreign Application Priority Data

Feb. 25, 1985 [AT] Austria ..... 560/85

[51] Int. Cl.[5] ..... A63C 5/12

[52] U.S. Cl. ..... 280/610

[58] Field of Search ..... 280/610

[56] References Cited

U.S. PATENT DOCUMENTS

| | | | |
|---|---|---|---|
| 2,525,618 | 10/1950 | Pierce | 280/610 |
| 2,611,623 | 9/1952 | Strand | 280/610 |
| 3,415,529 | 12/1968 | Grill et al. | 280/610 |
| 3,416,810 | 12/1968 | Kennedy et al. | 280/610 |
| 4,545,597 | 10/1985 | Meatto et al. | 280/610 |

FOREIGN PATENT DOCUMENTS

| | | | |
|---|---|---|---|
| 244816 | 1/1966 | Austria | 280/610 |
| 1375191 | 9/1964 | France | 280/610 |
| 62677 | 7/1940 | Norway | 280/610 |
| 111173 | 7/1944 | Sweden . | |
| 417430 | 2/1967 | Switzerland | 280/610 |

*Primary Examiner*—David M. Mitchell

*Attorney, Agent, or Firm*—Millen, White & Zelano

[57] ABSTRACT

The ski comprises (8,9) an intermediate layer between a top surface layer and a running surface. The intermediate layer comprises elements which have a parallelogram-shaped cross section and are inclined relative to the longitudinal center plane of the ski. The elements are alternately given different hardness and/or compressibility and/or bending elasticity.

22 Claims, 2 Drawing Sheets

SKI

BACKGROUND OF THE INVENTION

1. Field of the Invention

The invention refers to a ski comprising an assembly comprising at least one running surface layer, a top surface layer and at least one multiple-part intermediate layer.

2. Description of the Prior Art

In connection with some skis composed of different materials is has, for example, already become known to use, beside glass fiber laminates and aluminum layers, wood cores consisting of a plurality of layers glued together. Such wood cores are, as a rule, constructed such that the majority of bars of rectangular cross section is connected with one another. Most frequently, the individual bars are arranged within the ski such that the longitudinal sides of the rectangular cross-sectional profile contact one another, which results in increasing the stiffness and in a better stability. In case of bending stress there exists in such a type of construction only a reduced possibility of a relative shifting movement of the individual bars. The bending stress becomes, in case of an evading movement of the bars, primarily effective as a force component acting in normal direction on the glued areas. If cracks are produced in the glued surface areas, the composite structure is rapidly weakened with the rising risk of fracture. Therefore, it has already been proposed to improve the stability to envelope the multiple-part core or to enclose this core within a common hollow profile for forming some type of a torsion box. On account of the kinking stress of the torsion box when bending the ski, the desired strength properties and elasticity properties can be coped with to a limited extent in case of predetermined selection of materials.

SUMMARY OF THE INVENTION

The invention now aims at providing a simple construction of the initially mentioned type which has a higher resistance against fracture and which provides the possibility to provide the ski with a greater permanent deformation. For solving this task, the invention essentially consists in that one intermediate layer comprises elements of substantially parallelogram-shaped cross-section, which elements are inclined relative to the longitudinal center plane normally extending relative to the ski surface and are converging in direction to the top surface layer and which extend in longitudinal direction of the ski, a plurality of elements of differing hardness and/or bending elasticity being arranged in transverse direction relative to the longitudinal axis of the ski. In such a construction, any bending of the ski does not result in a load destroying the glueing seam but in a shearing load acting on the glued area, thus providing the possibility to counteract high bending torques without the risk of fracture. The selected type of connection furthermore provides the possibility to give the ski a high degree of permanent deformation without thereby influencing the risk of fracture. On account of elements of inclined orientation and of parallelogram-shaped cross section, which elements have differing hardness and/or bending elasticity, being provided, any bending deformation can more easily be absorbed by the more elastic or, respectively, softer element without subjecting as a whole the connection between the elements to overload. In contrast to elements having rectangular cross section and being arranged in upright position, any bending stress results there in an increase of the surface pressure between adjacent elements, so that a high strength can be obtained with the possibility to arbitrarily select the flexibility within broad limits. It is possible to use substantially the same constructional materials as are generally used in ski manufacture, and by using different adhesives or glues, respectively, the strength or bending characteristics, respectively, can substantially be influenced. In comparison with elements of upright arrangement, a greater contacting surface of adjacent elements is, based on equal constructional height, provided by the inclined elements of parallelogram-shaped cross section, so that the reliability of the firmness of the glueing connection is further favourized. On account of the elements of parallelogram-shaped cross section being arranged such that they converge in direction to the top surface, there results an increase of the surface pressure between the elements on occasion of any bending under load during skiing, so that a progressive spring characteristic can be achieved in case of bending.

The inventive construction can with particular advantage be used in connection with skis having their lateral cheeks arranged relative to the running surface at an angle differing from 90°. Such skis have the advantage of particularly favourable runnning properties, in particular of distinct improvements when skiing along curved paths. In this case, the elements are advantageous at an angle of 10° to 40° relative to the longitudinal center plane and are glued one with the other at the contacting surfaces. The bending elasticity can equally be influenced by selecting the number of elements inclined in one direction relative to the longitudinal center plane as compared with the number of elements inclined in the opposite direction. In an advantageous manner, the arrangement is, however, such that the number of elements arranged with opposite inclination one relative to the other is equal at both sides of the longitudinal center plane. In each case, any tendency of expansion of the core or the intermediate layer, respectively, is counteracted, the bending stress resulting, beside an increase of the surface compression, at most in a shearing stress of the adhesive seam or, respectively, glue seam, which shearing stress can easily be absorbed on account of the greater contacting surface.

A particularly high elasticity in connection with a high resistance against fracture results if the arrangement is such that, as seen in direction transverse to the longitudinal axis of the ski, there is alternately connected an element of a material of greater hardness and/or bending stiffness with an element of a softer and/or more elastic material. In this manner, the load is absorbed under a condition as equally distributed over the whole cross section of the individual layer and any risk of local overload is avoided.

The lateral cheeks can in usual manner be formed of synthetic plastics material, for example of phenolic resin. For improving the strength properties and the carrying capacity for mechanical pressure of the lateral cheeks, the elements located adjacent the lateral cheek can be formed of a material of greater hardness.

Connection of the lateral cheeks with the elements located adjacent said lateral cheeks is advantageously effected by means of an elastic adhesive seam. In this manner, the intermediate layer is better protected against becoming mechanically damaged.

The flexibility behavior can be improved by interconnecting the elements one with the other in a shear-elastic manner. In this case, there can advantageously be used also intermediate elements having a higher compressibility in transverse direction to the longitudinal direction of the ski. Such elements of higher compressibility can like other elements be given a different width, in particular a smaller width as compared with that of the harder elements. By selecting a corresponding number of elements, the arrangement can, for obtaining a soft core, advantageously be such that in proximity of the longitudinal center plane there are arranged two elements, preferably of a softer and/or more elastic material, with opposite inclination relative to the longitudinal center plane for forming a core of substantially triangular contour. If the elements located adjacent the lateral cheeks are designed as hard elements, there results at both sides of the longitudinal center plane an even number of elements, so that there remain in the central area two softer elements each. The core of substantially triangular contour can, in such a construction, remain hollow but can also be filled with a mass of synthetic plastics material, in particular with polyurethane or an adhesive.

In case of lateral cheeks being inclined relative to the longitudinal center plane of the ski, the inclination of the elements can in a particularly simple manner be selected to extend in parallel relation to the inclination of the lateral cheeks of the ski.

A further possibility for influencing the bending properties consists in selecting different inclinations of individual sections within the intermediate layer. However, the arrangement is in an advantageous manner such that the inclination of the elements is equal but opposite at both sides of the longitudinal center plane. In such an arrangement, there is again obtained uniform absorbance of the bending stress over the whole cross section and over the total width of the intermediate layer.

The individual elements may consist of different types of wood or synthetic plastics material, in particular of synthetic plastics material being reinforced in different manner.

The arrangement according to the invention can also be used in connection with skis having a usual core, noting that in this case only some of the elements located adjacent the lateral cheeks are arranged, whereas the core itself is manufactured in usual and common manner. The core located between elements being oppositely inclined one relative to the other can have a substantially rectangular or trapezoidal cross section. In particular, such a core can also be formed of upright elements of rectangular cross section, noting that the risk of a lateral expansion on occasion of bending stress is avoided on account of the increase of the compression by the outwardly arranged elements of mutual opposite inclination. In addition, the core itself can, for increasing its strength properties, be designed in a manner known per se as a torsion box.

BRIEF DESCRIPTION OF THE DRAWING

In the following, the invention is further explained with reference to embodiments shown in the drawing.

In the drawing

DETAILED DESCRIPTIONS OF THE PREFERRED EMBODIMENTS

Figure 1:
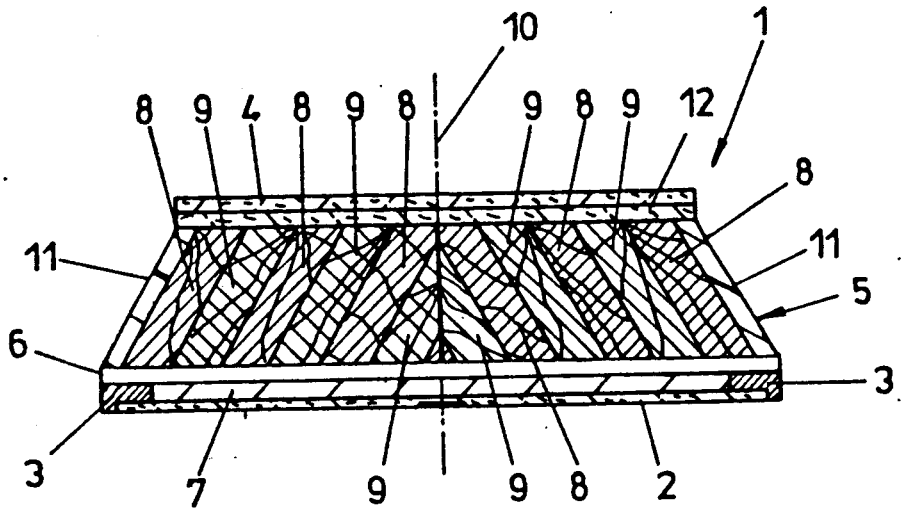
FIG. 1 shows a cross section through a first embodiment of a ski according to the invention.

In FIG. 1, there is shown a ski 1. The ski 1 has a running surface 2 comprising a suitable layer. Ridges 3 are provided at the lateral edges of the ski. The top surface layer of the ski is designated by 4. An attenuating layer 6 is advantageously provided between the running surface 2 and the intermediate layer 5. On account of the ridges being embedded into the material of the ski, the cavity most frequently formed is filled with a further layer, in particular of aluminium or of a glass fibre laminate. This layer is designated by 7.

The intermediate layer 5 consists of individual elements 8 and 9 of parallelogram-shaped cross section, noting that the elements being designated by 8 are formed of a harder material than the elements designated by 9. As a whole, an even number of such elements is stacked at both sides of the longitudinal center plane 10, so that two elements 9 of softer material contact one another in the central area for forming a softer core. In this case, the harder elements 8 are located adjacent the lateral cheeks 11, which are in usual manner formed of a phenolic resin. The elements arranged at both sides of the longitudinal center plane 10 are oppositely inclined one relative to the other. The angle included by these elements with the longitudinal center plane 10 is approximately 30°. The elements converge in direction to the top surface layer 4, noting that in the representation according to FIG. 1 there is provided between the intermediate layer 5 and the top surface layer 4 still a further layer 12 formed of a glass fibre laminate or of aluminium.

Figure 2:
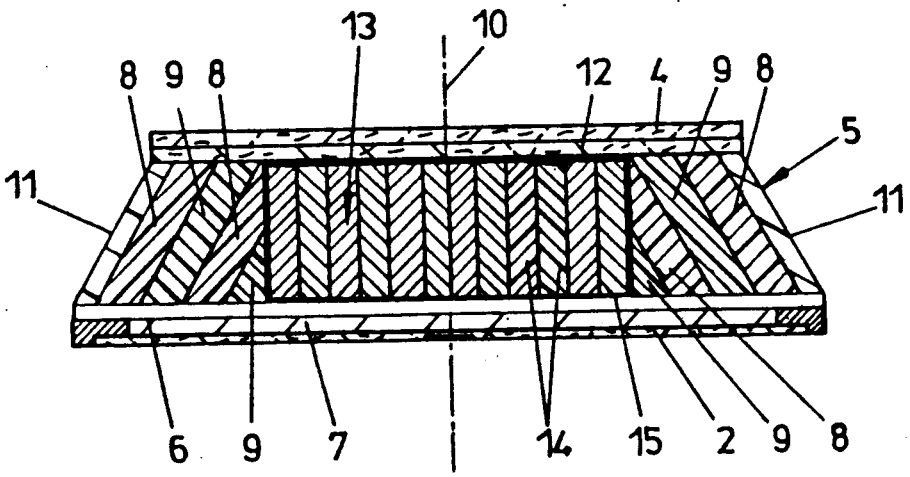
FIG. 2 shows an analogous cross section through a modified embodiment

The embodiment according to FIG. 2 differs from the embodiment according to FIG. 1 by the additional provision of a separate core 13. The core 13 consists of a plurality of elements 14 of rectangular cross section which are combined by wrapping to form a torsion box 15. Also in this embodiment, any bending counteracts any tendency of lateral expansion, noting that the forces become effective as compression forces directed to the longitudinal center plane 10 of the ski.

Figure 3:
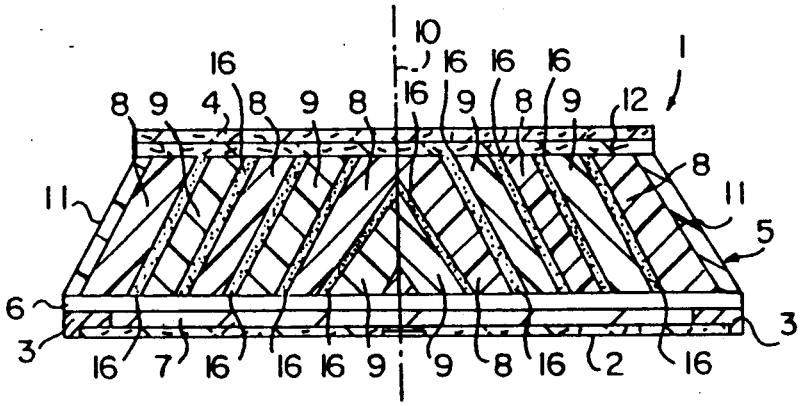
FIG. 3 shows an analogous cross section through still another embodiment of the invention.

Referring now to FIG. 3 there is shown still another embodiment of the invention wherein in between the elements 8 and 9 there are elements 16 of a smaller width than the elements 8 and 9. The element 16 may be of higher compressibility in the direction of the width of the ski than the compressibility of elements 8 and 9.

What is claimed is:

1. A ski (1) assembly, said assembly comprising at least one running surface layer (2) and a top surface layer (4) disposed normal to a longitudinal plane and at least one multiple-part intermediate layer (5) bisected by the center plane and disposed between the surface layers characterized in that said intermediate layer (5) comprises elements (8, 9) of substantially parallelogram-shaped cross-section retained between lateral cheeks (11), which elements are inclined relative to the longitudinal center plane (10), converge toward one another in the direction of the top layer (4), and extend longitudinally within the ski, a plurality of said elements (8, 9) being of different bending elasticity arranged in traverse direction relative to the longitudinal axis of the ski (1) and being in abutment with one another.

2. The ski as claimed in claim 1, characterized in that the elements (8, 9) are arranged in abutment with one another over contacting surfaces thereof with an angle of inclination of 10° to 40° relative to the longitudinal center plane (10) and are glued one with the other at the contacting surface.

3. The ski as claimed in claim 2, characterized in that the number of elements (8, 9) is the same at both sides of the longitudinal center plane (10) and that the elements on the sides of the longitudinal center plane are of mutually opposite inclination.

4. The ski as claimed in claim 1, characterized in that, in transverse direction to the longitudinal axis of the ski (1), there is alternately connected one element (8) of a material of greater bending stiffness with an element (9) of a more elastic material.

5. The ski in claim 1, characterized in that in proximity of the longitudinal center plane (10) there are connected two elements (9), which consist of a softer and/or more elastic material than the other elements, the two elements being of opposite inclination relative to the longitudinal center plane (10) to form a core of substantially triangular cross section.

6. The ski as claimed in claim 1, characterized in that the inclination of the elements (8, 9) is in parallel relation to the inclination of the lateral cheeks (11) of the ski (1).

7. The ski as claimed in claim 1, characterized in that the outer elements (8) located adjacent the lateral cheeks (11) are formed of a material of greater hardness and/or of bending stiffness then the other elements.

8. The ski as claimed in claim 1, characterized in that the elements (8) located adjacent the outer lateral cheeks (11) are connected with the lateral cheeks (11) by an elastic adhesive seam.

9. The ski as claimed in claim 1, further including means for connecting the elements (8, 9) one with the other in a shear-elastic manner.

10. The ski as claimed in claim 1, characterized in that between adjacent elements (8, 9) there are interconnected elements.

11. The ski as claimed in claim 1, characterized in that the inclination of the elements (8, 9) is equal but opposite at both sides of the longitudinal center plane (10).

12. The ski of claim 1, wherein the elements (8, 9) are comprised of wood.

13. The ski as claimed in claim 1, characterized in that a core (13) of members (14) having substantially rectangular cross section is arranged between elements (8, 9) of mutually opposite inclination.

14. The ski as claimed in claim 10 wherein the interconnecting elements have a width less than the adjacent elements.

15. The ski as claimed in claim 14 wherein the interconnecting elements have a higher compressibility than the adjacent elements.

16. The ski as claimed in claim 10 wherein the interconnecting elements have a higher compressibility than the adjacent elements.

17. The ski as claimed in claim 1 characterized in that the elements (8, 9) consist of wood.

18. The ski as claimed in claim 17, characterized in that a core (13) of members (14) having substantially rectangular cross-sections is arranged between elements (8, 9) of mutually opposite inclination.

19. The ski of claim 1, wherein at least some of the elements (8, 9) are composed of synthetic plastic material.

20. The ski of claim 19 wherein at least some of the elements are made of wood.

21. The ski of claim 1 wherein at least some of the elements (8, 9) are comprised of synthetic plastic materials with some elements having different reinforcement than other elements.

22. The ski of claim 21 wherein at least some of the elements (8, 9) are made of wood.

* * * * *